United States Patent [19]

Johnson

[11] 4,287,497

[45] Sep. 1, 1981

[54] INTEGRATED UNIVERSAL RF JOINT AND GIMBAL SYSTEM

[75] Inventor: Robert A. Johnson, Tempe, Ariz.

[73] Assignee: Motorola Inc., Schaumburg, Ill.

[21] Appl. No.: 47,832

[22] Filed: Jun. 12, 1979

[51] Int. Cl.[3] ..... H01P 1/06; H01P 5/08

[52] U.S. Cl. ..... 333/261; 333/21 R; 333/248; 343/765

[58] Field of Search ..... 333/256, 261, 248, 21 R, 333/21 A, 1, 33; 343/756–758, 765–766

[56] References Cited

U.S. PATENT DOCUMENTS

| | | | |
|---|---|---|---|
| 2,463,347 | 3/1949 | Aron et al. | 333/256 |
| 2,476,732 | 7/1949 | Hollingsworth et al. | 333/256 X |
| 2,784,383 | 3/1957 | Zaleski | 333/261 |
| 2,830,276 | 4/1958 | Zaleski | 333/256 |
| 2,962,677 | 11/1960 | Edwards | 333/256 X |
| 4,020,431 | 4/1977 | Saunders | 333/256 |
| 4,071,833 | 1/1978 | Gould | 333/33 |

*Primary Examiner*—Marvin L. Nussbaum

*Attorney, Agent, or Firm*—M. David Shapiro; Eugene A. Parsons

[57] ABSTRACT

A compact gimbal system having an integral radio frequency signal path therethrough wherein common bearings are utilized in the rotary joints of the radio frequency path and for supporting and rotating the gimballed load and wherein radio frequency waveguide may be used as at least a part of the required structure of the system.

10 Claims, 2 Drawing Figures

INTEGRATED UNIVERSAL RF JOINT AND GIMBAL SYSTEM

FIELD OF THE INVENTION

The invention relates to a compact integrated universal RF joint and gimballing system.

BACKGROUND OF THE INVENTION

Prior art gimballing systems for small missiles have prsented difficult design problems. Design objectives invariably require minimum swept volume for the sensing device (usually an antenna) which is gimballed. At the same time, systems frequently require included sweep angles of around 140°. Designers have long been faced with the problem of generating maximum sweep angles while maintaining minimum swept volume.

As output power requirements are increased in such systems, it has become more and more difficult to deliver that power to the element which is gimballed. While it is possible in low power systems to use flexible coaxial cable for this purpose, it becomes less practical to do so in higher power systems. As the result of increased sweep rates, the cable is frequently flexed beyond its limit and fails in use. When heavier cable is used in an effort to avoid this problem, higher torques are required from the gimbal drive motors thereby having a detrimental effect on system expense, weight and/or response time.

SUMMARY OF THE INVENTION

The instant invention solves the above and other problems by means of a pair of universal RF joints organized in orthogonal fashion, one to the other. Each joint comprises a rectangular wave guide feeding or fed from coaxial transmission line means. The coaxial transmission line becomes an integral part of a casting or machined element which also mounts the rotary joints and the bearings thereof.

It is therefore an object of the instant invention to provide an integrated compact RF universal joint and gimballing system for a small missile sensor.

It is another object of the invention to provide an integrated RF universal joint and gimballing system for a relatively high power antenna.

It is still another object of the invention to provide a compact integrated gimballing and RF feed system wherein elements of the RF feed system provide structure support for the system.

These and other objects of the invention will become more clearly understood upon study of the detailed description of the invention, below, together with the drawings in which.

DETAILED DESCRIPTION OF THE INVENTION

Figure 1:
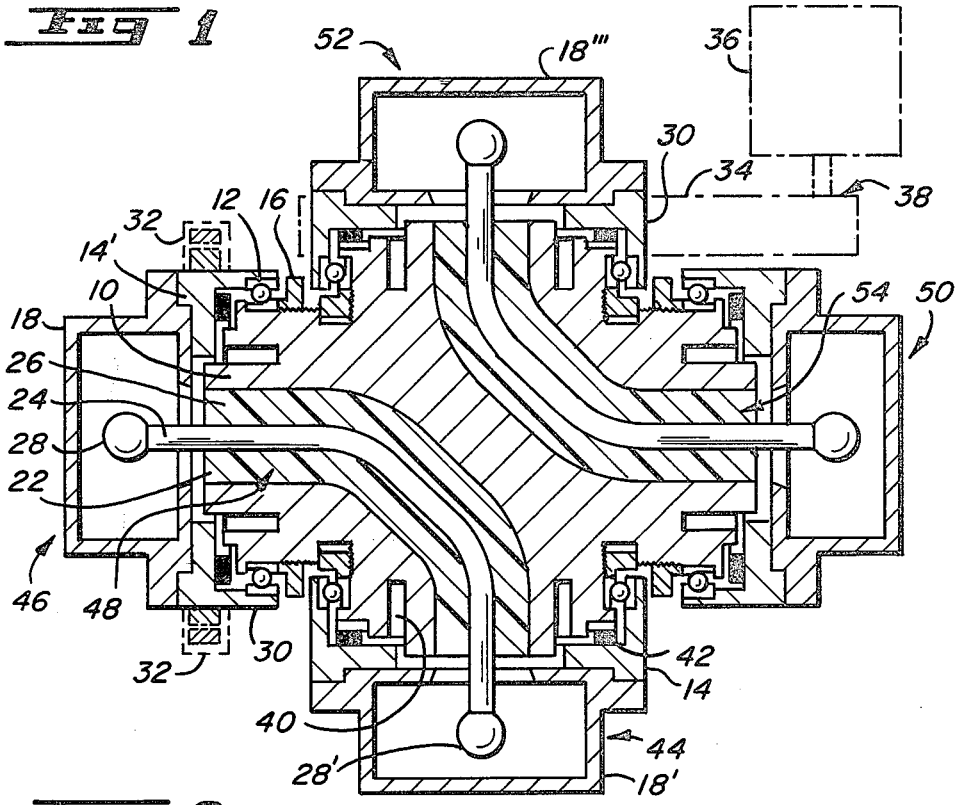
FIG. 1 is a cross-sectional view of the invention.
Figure 2:
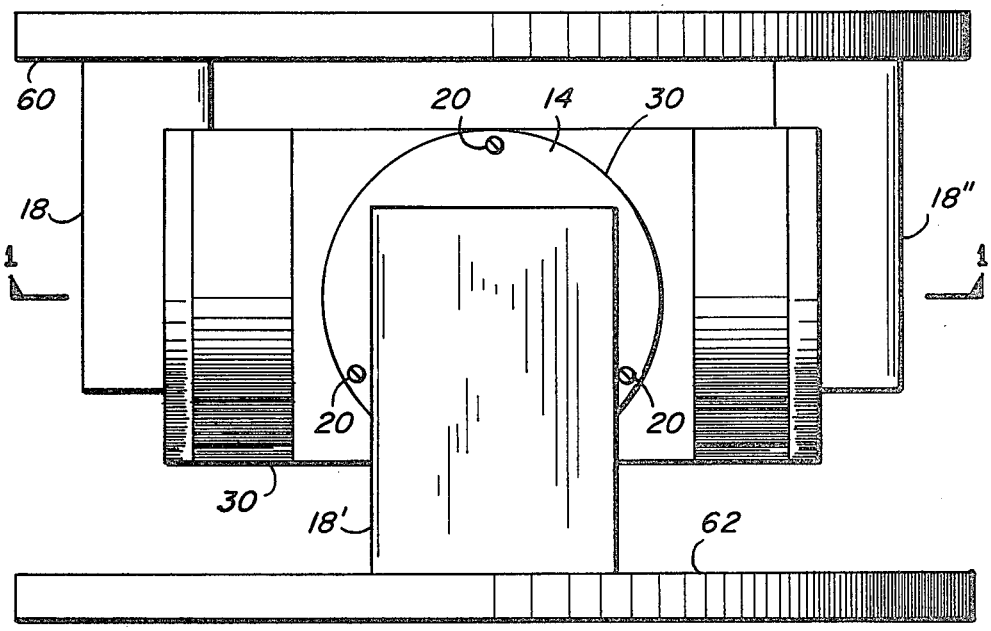
FIG. 2 is a side view of the invention.

Referring to FIG. 1, it will be seen that body member 10 is shown in cross-section. Body member 10 may be a casting or machined part. Body section 10 may be molded in two halves, mirror images of each other, as typified by FIG. 1. Bearing 12 provides a rotary mount for wave guide base 14. Bearing 12 may be preloaded by means of threaded ring 16. Rectangular wave guide 18 is fastened to wave guide base 14 (as shown in FIG. 2). This is accomplished by means of machine screws 20 as shown in FIG. 2. Base member 10 has semicircular groove 22 therein. The surface of semicircular groove 22 serves as the outer conductor of coaxial transmission line 48. Inner conductor 24 of the transmission line is held in place by dielectric 26. This dielectric may be of plastic, ceramic or other suitable material. Inner conductor 24 of tranmission line 48 is terminated by ball structure 28. Ball 28 provides for a suitable electrical transition between wave guide 18 and the transmission line comprising outer conductor 22 and inner conductor 24.

Mounting base 14 for wave guide 18 has a circular perimeter 30 which may be seen from FIG. 2. This circular form lends itself well to mounting of torque motors such as the one shown at 32 in FIG. 1. As may be seen, the rotor of torque motor 32 is attached to waveguide base 14 while its stator is connected to mounting body 10 of the invention. An alternate means for driving the gimbal system comprises belt 34 and motor 36 as shown in phantom in FIG. 1. Belt 34 may be in contact with curved surface 30 of wave guide mounting base 14 over more than 180° of the perimeter. Belt or tape 34 is, in turn, driven from drive drum 38 (not shown) attached to the shaft of motor 36. Normally this system would be used to drive the input axis of the gimbal since motor 36 may then be mounted on the pedestal of the system. The coaxial torque motor shown at 32 may best be utilized on the second axis of the system.

Gimbal body 10 is constructed with quarter wave choke slots 40 therein. As will be well understood by one of average skill in the art, choke slots 40 provide a very high impedance at the interface between gimbal body 10 and rectangular wave guide structure 18. However since such an arrangement is not perfect, absorbers 42, comprising a high loss dielectric, are supplied to prevent RF energy from being radiated into the area of bearings 12.

What has been described to this point is the universal joint comprising rotary joints 44 and 46 interconnected by coaxial transmission line 48. A similar system comprising rotary joints 50 and 52 joined by coaxial transmission line 54 is shown. This second universal joint may be utilized in a system wherein two RF transmission lines to the sensor may be required. In those systems where only a single RF transmission line is required, the system comprising rotary joints 50 and 52 and coaxial transmission line 54 may be repalced by a dummy system including only the bearings and the other structural parts of the system. Alternatively the cavities in the second universal joint comprising wave guide joints 50, 52 and coaxial transmission line 54 may be utilized for the routing of cables used for other purposes, for example, power lines for torque motors. Of course, in that case, the center conductor of transmission line 54 may be eliminated from the system as would be any dielectric within the coaxial transmission line cavity.

It is a feature of the invention that the rectangular wave guide sections such as that shown at 18 may be utilized as structural members with which to mount the gimbal system on a suitable pedestal or with which to mount an antenna or other sensor to the output end of the gimbal system. This feature becomes especially attractive in those systems where weight and size are at a premium.

It will become apparent that the system that has been described is extremely compact and useful because of the dual purpose served by some of the elements of the integrated system. This fact becomes even more apparent when consideration is taken of the small size of very high frequency systems such as K band and higher. Even at X band, the particular configuration of the invention lends itself to extremely compact and rugged systems.

FIG. 2 represents a side view of the invention. It may be seen that wave guide 18 and 18'' (or a dummy substitute for wave guide 18'') may be utilized to mount the system of the invention to a suitable antenna base 60. Similarly wave guide 18' and another wave guide 18''' (or suitable dummy substitute thereof, not shown) may be utilized to mount the system to a pedestal. The configuration, as shown, places both axes of the gimbal system in the same plane and very close to sensor or antenna 60. This provides a minimum swept volume of the system in operation. The inherent high power capability of rigid transmission line such as 48 and 54, the transitions into wave guides and the use of rectangular wave guide 18 allow for a relatively high power operational capability with no possibility of significant degradation in the RF system. The integral design of the transmission system and the mechanical and structural portions of the gimbal system provide a relatively low cost, light weight, rugged structure.

While the invention has been particularly shown and described with reference to a preferred embodiment thereof, it will be understood by those skilled in the art that various other modifications and changes may be made to the invention from the principles of the invention described above without departing from the spirit and scope thereof as encompassed in the accompanying claims. Therefore, it is intended in the appended claims to cover all such equivalent variations as may come within the scope of the invention described.

I claim:

1. An integral universal joint for transmission of radio frequency energy comprising in combination:

a first rotary radio frequency joint;

a second rotary radio frequency joint; and a coaxial transmission line, said first and second rotary radio frequency joints each having a rotational axis, each of said axes being substantially orthogonal to the other, said coaxial transmission line having two ends thereof, each of said ends having a radio frequency transition to a waveguide of one of said first and second rotary radio frequency joints wherein one of said waveguides is a first terminal of the universal joint and a second of said waveguides is a second terminal of the universal joint.

2. The apparatus according to claim 1 wherein said coaxial transmission line comprises:

an outer conductor, said outer conductor being the inner surface of a cavity in a structural member of the universal joint said cavity having a circular cross-section.

3. The apparatus according to claim 2 further comprising:

at least one axial bearing, said bearing being rotatably mounted between said structural member of the universal joint and said waveguide of one of said rotary joints.

4. The apparatus according to claim 1, 2 or 3 wherein said coaxial transmission line has an outer conductor comprising the surfaces of cavities in at least two conductive bodies, said at least two conductive bodies being in cooperative relationship to form said outer conductor.

5. A combination radio frequency universal joint and gimbal system comprising in combination;

a first rotary radio frequency joint;

a second rotary joint, said first rotary radio frequency joint and said second rotary joint being on a first common rotational axis;

a third rotary radio frequency joint;

a fourth rotary joint said third rotary radio frequency joint and said fourth rotary joint being on a second common rotational axis, said second common axis being substantially orthogonal to said first common axis; and at least one transmission means for joining at least said first and third rotary radio frequency joints and for allowing radio frequency energy transmissions to take place through the universal joint and gimbal system.

6. The apparatus according to claim 5 further comprising:

at least one signal source terminal and at least one signal load terminal, each of said terminals being a part of one of at least said first and third rotary radio frequency joints, said terminals for accepting radio frequency energy and for transmitting radio frequency energy, one of said terminals being structurally attached to a pedestal, another of said terminals being structurally attached to a sensor, the universal joint being integral with the gimbal system thereby formed.

7. The system according to claim 6 wherein each of said rotary joints comprises an axial bearing system, said axial bearing systems providing for orthogonal rotation in at least two axes of said integral gimbal system.

8. The apparatus according to claim 5, 6 or 7 wherein said transmission means comprises a cavity in a structural member of the universal radio frequency joint and gimbal system.

9. The apparatus according to claim 5, 6 or 7 wherein said transmission means comprises a cavity in a structural member of the universal radio frequency joint and gimbal system and wherein said cavity has an inner surface, said inner surface being the outer conductor of a coaxial transmission line.

10. The apparatus according to claim 5, 6 or 7 wherein said second and fourth rotary joints are radio frequency joints and said at least one transmission means comprises a radio frequency connection of said second and fourth joints for allowing other radio frequency energy transmission to take place therebetween through the universal joint and gimbal system.

* * * * *